US006632187B2

(12) United States Patent
Bak

(10) Patent No.: US 6,632,187 B2
(45) Date of Patent: Oct. 14, 2003

(54) FOOT NERVE PULSATOR

(75) Inventor: Tan Khee Bak, Singapore (SG)

(73) Assignee: Rotol (Singapore) Ltd., Zhejiang (CN)

( * ) Notice: Subject to any disclaimer, the term of this patent is extended or adjusted under 35 U.S.C. 154(b) by 205 days.

(21) Appl. No.: 09/835,540

(22) Filed: Apr. 16, 2001

(65) Prior Publication Data

US 2001/0034497 A1 Oct. 25, 2001

(30) Foreign Application Priority Data

Apr. 19, 2000 (SG) ..... 00115421

(51) Int. Cl.[7] ..... A61H 7/00
(52) U.S. Cl. ..... 601/134; 601/136; 601/27
(58) Field of Search ..... 601/22, 27, 28, 601/134, 136, 137, 138, 103, 111, 112, 104, 70, 72–73, 80, 101, 133

(56) References Cited

U.S. PATENT DOCUMENTS 3,625,204 A * 12/1971 Sekiguchi ..... 601/134
4,210,134 A * 7/1980 Okazaki et al. ..... 601/134
5,096,188 A * 3/1992 Shen ..... 601/134
5,681,266 A * 10/1997 Lin ..... 601/104
5,868,688 A * 2/1999 Avidor et al. ..... 601/104
6,013,042 A * 1/2000 Sakai ..... 601/134
6,146,342 A * 11/2000 Glen ..... 601/111

FOREIGN PATENT DOCUMENTS

CN 23444475 8/1997 ..... A61H/39/04
CN 2359319 11/1997 ..... A61H/15/00

* cited by examiner

*Primary Examiner*—Nicholas D. Lucchesi
*Assistant Examiner*—Quang D. Thanh
(74) *Attorney, Agent, or Firm*—George O. Saile; Stephen B. Ackerman

(57) ABSTRACT

A pulsator assembly for massaging the plantar and transverse arch regions of a foot. An array of spring loaded pistons extending upward through holes in an upper shell structure forms a topology conforming to the plantar and arch regions of a human foot. The piston tips that making contact with the foot has shapes selected from a choice of nipple shaped ends or inserts made from a permanent magnetic. The pistons are urged up and down in concert with the opposing forces imposed by a walking action, thereafter, massaging while stimulating the plantar arch region of the soles without exerting excessive forces to the transverse arch region.

20 Claims, 6 Drawing Sheets

FOOT NERVE PULSATOR

BACKGROUND OF THE INVENTION (1) Technical Field

This invention relates to an apparatus and method for massaging the undersurface of a foot of an individual. More particularly, the invention relates to nerve stimulation by urging a plurality of conforming protuberances to the plantar region of a foot.

(a) Technical Field of the Invention

The present invention relates to a device for massaging the soles of a foot of a user of the device, and in particular, a foot nerve pulsator device which has a plurality of massaging pistons to massage the soles.

(b) Description of the Prior Art

One way of enhancing blood circulation through a foot to promote body health is to walk bare foot on roads paved with stones, gravel and soils. This is because the foot nerves on the soles are stimulated by the unevenness of a road's surface. A way of simulating this form of massaging the soles of a foot is to promote a form of foot stimulation for better health. A number of devices for massaging the soles have been developed, and these devices allow the user to exercise while being barefoot on the surface thereof.

China Utility Patent No. 96235931 discloses a pedal for soles massaging comprising a flat bottom plate having a plurality of densely distributed uneven height massaging protrusions.

Another conventional art, China Utility Patent No. 95234447, discloses a moveable soles massaging board comprising a rectangular bottom board mounted with a plurality of rows and columns of positioned holes, wherein a plurality of nipple-shaped massaging protrusions are inserted into the individual holes. The massaging protrusions of the above conventional art are not moveable and thus the effectiveness of stimulating by massaging at the plantar arch region of the sole is rather limited but that at the transverse arch region of the sole is excessively large.

Accordingly, it is an object of the present invention to provide a foot nerve pulsator device, which can mitigate the above-mentioned drawbacks.

SUMMARY OF THE INVENTION

It is an object of the present invention to provide a foot nerve pulsator device, in which the massaging protrusions are moveable in the course of operation of the device.

An aspect of the present invention is to provide a foot nerve pulsator device for massaging soles which includes an assembly having a molded upper shell structure contoured to the plantar and transverse arch regions of the foot. The upper shell structure is secured at its base perimeter, to a molded base platform, being attached to the base platform by screws. Enclosed within this two piece assembly are an array of hollow massaging pistons having a closed top end and an open flanged end. The pistons are movable within an array of holes in the upper shell structure. The holes extend downward through cylindrical sleeves molded to the underside of the upper shell structure. The array of holes contain a plurality of rows, in which alternate rows have hole diameters corresponding to one of two different massaging piston diameters.

The base structure includes an array of upwardly extended posts matching the hole array in the upper shell structure.

The posts are made with a lower shoulder length in which the shoulder length conforms with the contour of the upper shell structure. A plurality of compressed springs, each having a first end placed over each post and resting on the lower shoulder length. The other end, is compressed and placed into the open flanged end of the massaging piston urging the massaging piston upward against the cylindrical sleeves. The shapes of the closed ends are selected from a choice of nipple shaped ends or inserts made from a permanent magnetic material.

A further object of the present invention is to provide a foot nerve pulsator device, wherein the massaging pistons are supported by spring and are moveable in up and down in direction in accordance with the stepping of the soles.

Yet another object of the present invention is to provide a foot nerve pulsator device, wherein the shape of the covering surface of the individual massaging pistons is similar to that of the soles, and the plantar arch region of the sole is sufficiently stimulated while the transverse arch region of the soles is not excessively pressed by force.

Other objects and advantages of the invention will become apparent upon reading the following detailed description and upon reference to the drawings.

DETAILED DESCRIPTION OF THE PREFERRED EMBODIMENT

Figure 1:
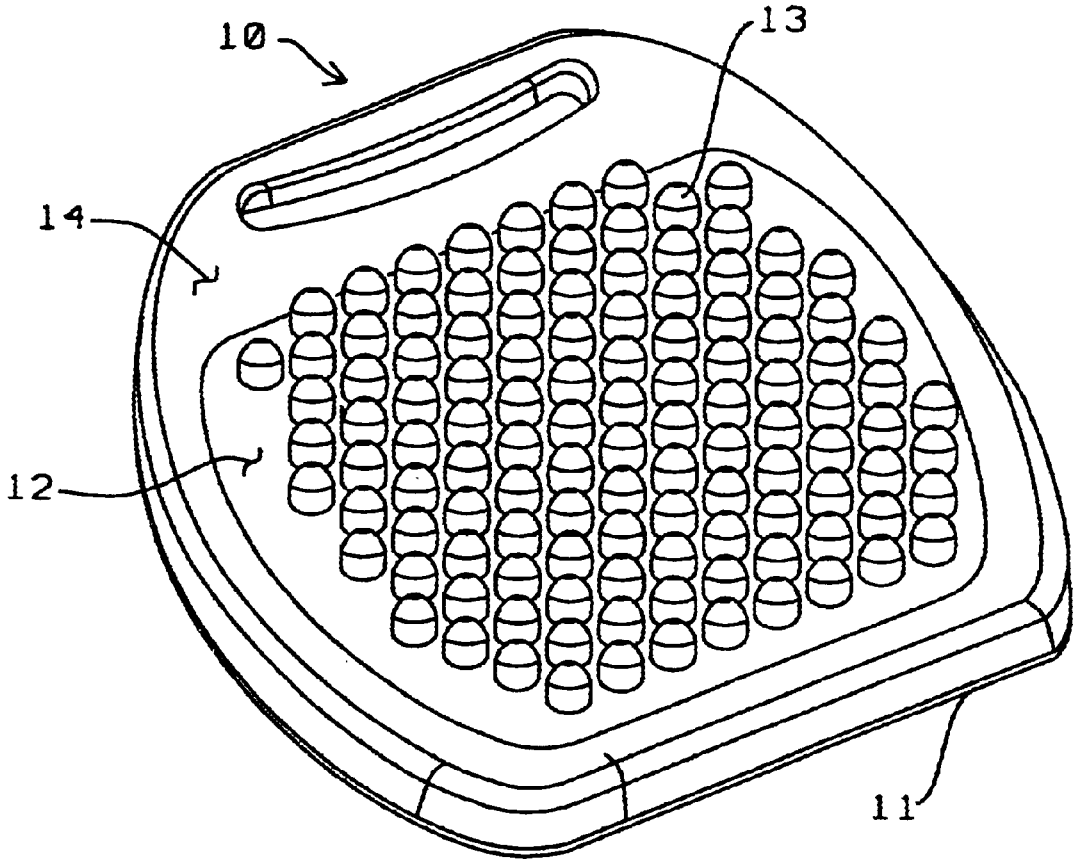
FIG. 1 is an isometric view of a foot nerve pulsator device in accordance with the present invention.
Figure 2:
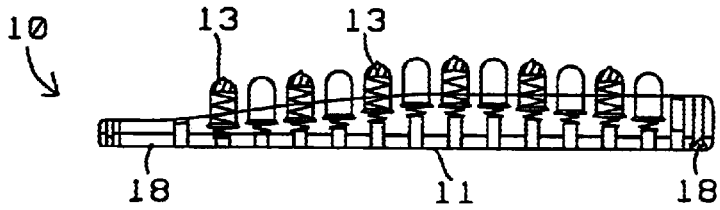
FIG. 2 is a sectional view of a foot nerve pulsator device in accordance with the present invention.
Figure 5:
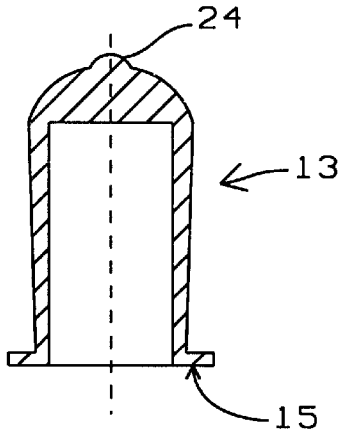
FIG. 5 is a cross-sectional view of the hollow massaging piston with a nipple shaped end of the present invention.

Referring now to FIGS. 1 to 2, there is shown a foot nerve pulsator device 10 for massaging soles of the foot. The nerve pulsator device is an assembly which includes a two piece molded upper shell structure 12, 14 secured at its base perimeter to a molded base platform 11 with screws 18. The upper shell structure 12, 14 is contoured to the plantar and transverse arch regions of the foot. Enclosed within this assembly are an array of hollow massaging pistons 13 having prearranged row positions containing two different cylindrical diameters. FIG. 2 illustrates a cross-section view of the nerve pulsator device showing the rows containing pistons with the smaller cylindrical diameters in cross-section, while the rows with the larger pistons not in cross-section. FIG. 5 shows the massaging pistons 13, each having a closed top end 24 and an open flanged end 15. The pistons are movable within an array of holes 16 in the upper cover 12. The array of holes 16 extend downward through cylindrical sleeves 17 molded to the underside of the upper cover 12 (see FIG. 7). The array of holes 16 contain a plurality of alternate rows 19 and 20, in which rows 19 have smaller hole diameters to slidably contain the smaller massaging piston diameters and rows 20 with larger hole diameters to slidably contain the larger massaging piston diameters.

Figure 3:
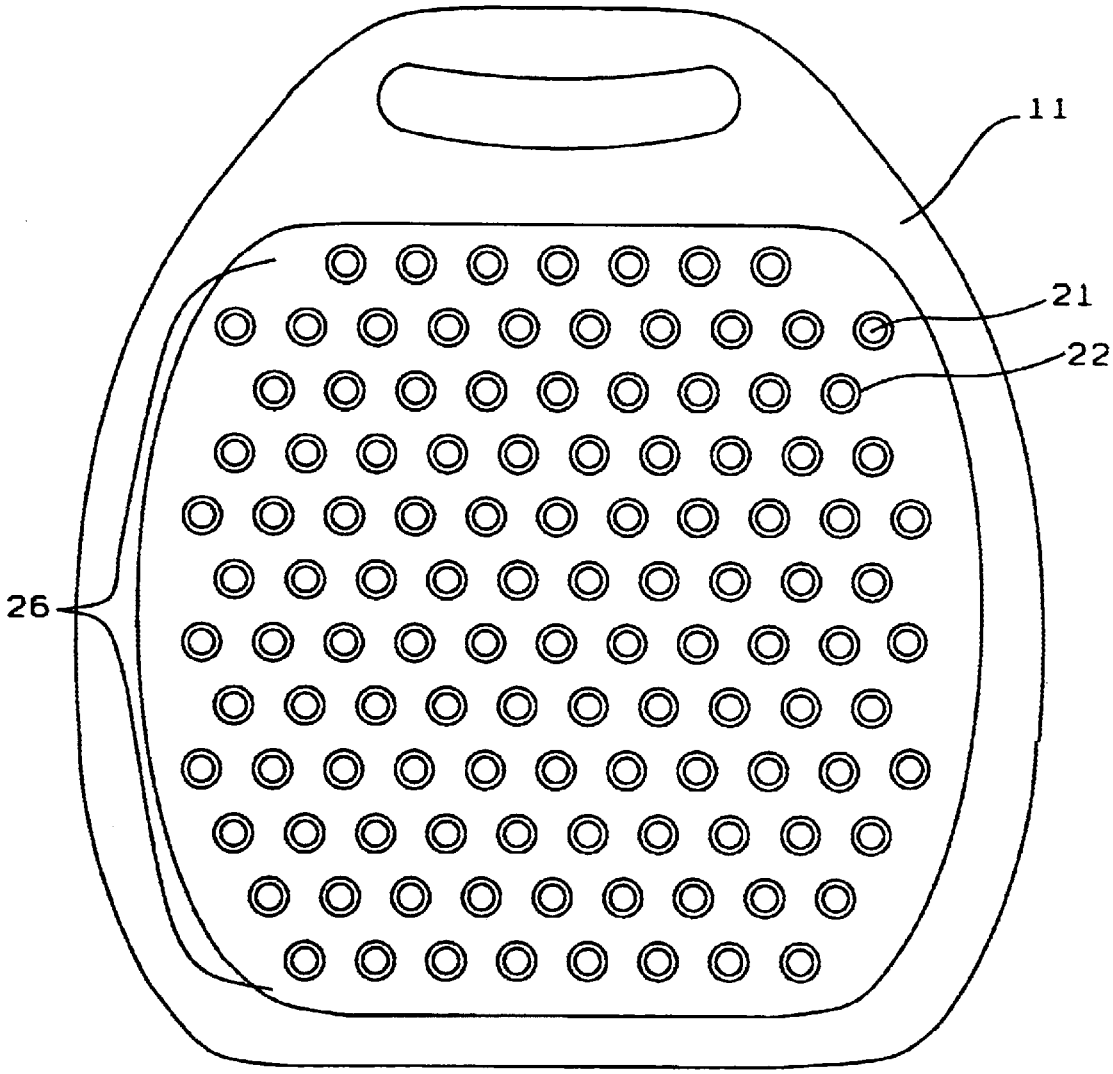
FIG. 3 is a top schematic view of the base structure of the foot nerve pulsator device of the present invention.
Figure 4:
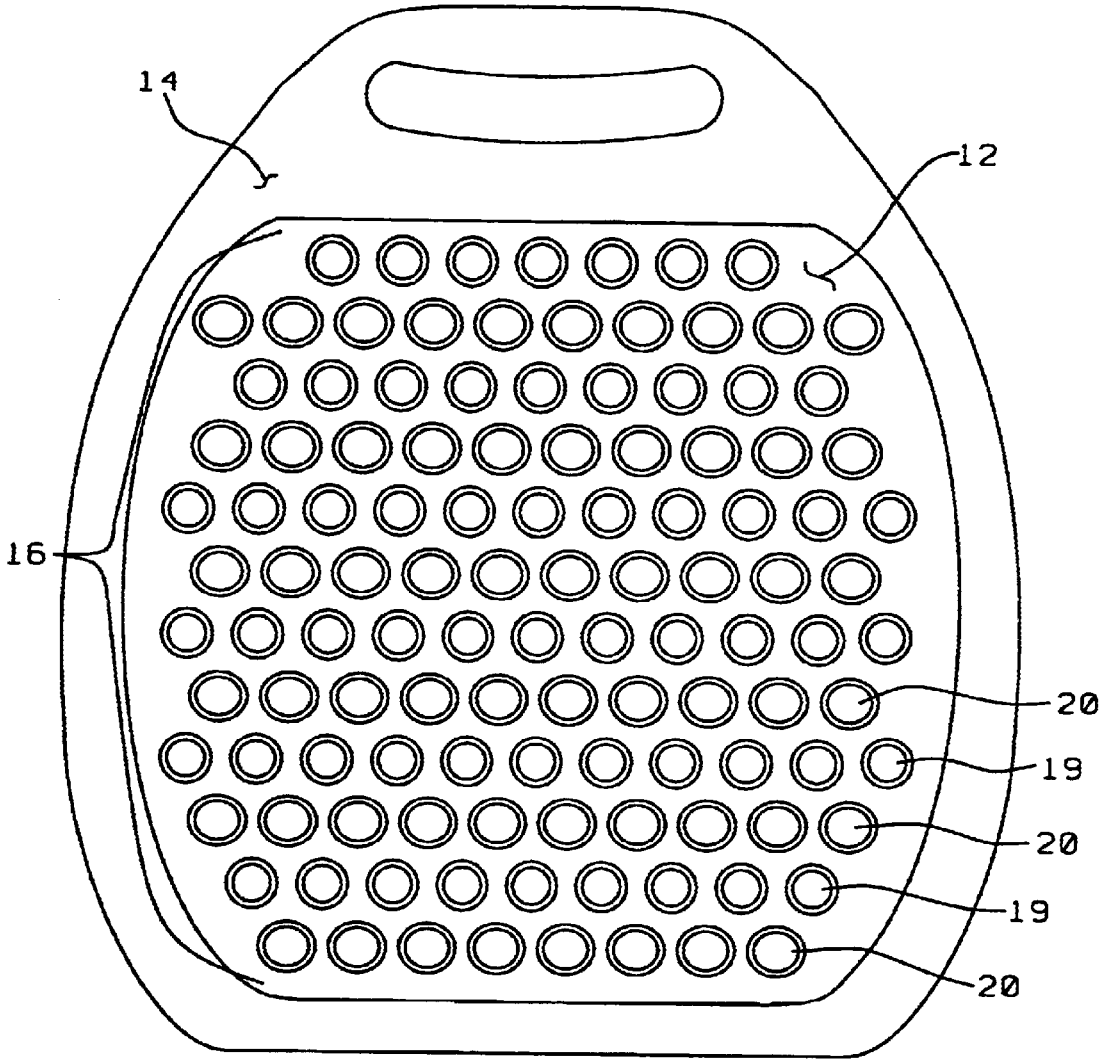
FIG. 4 is a top schematic view of the upper shell structure of the foot nerve pulsator device of the present invention
Figure 7:
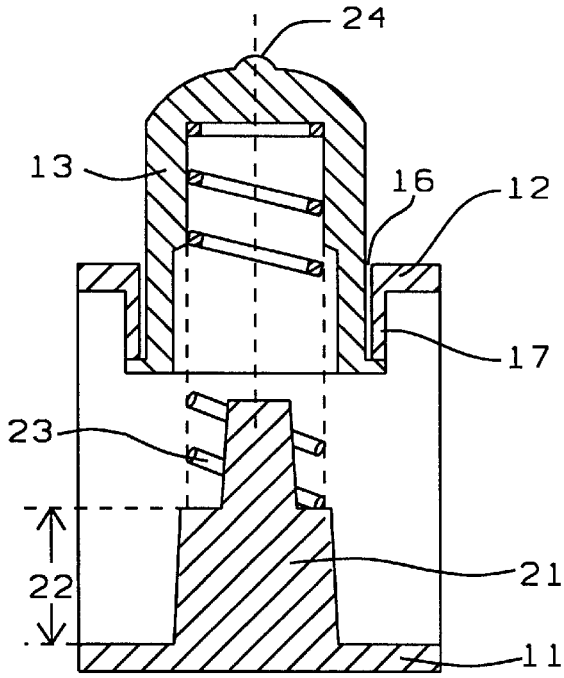
FIG. 7 is a fragmented sectional view showing the assembly workings of the present invention.
Figure 8:
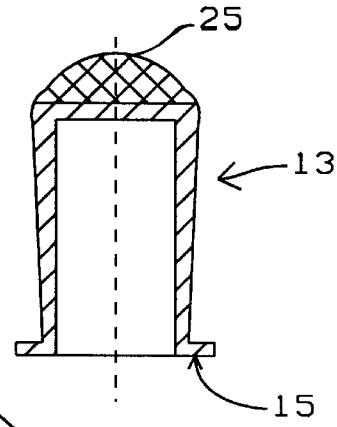
FIG. 8 is a sectional view of a hollow massaging piston with an insert made from a permanent magnet in accordance with the present invention.

The base platform 11 includes an array 26 of upwardly extended posts 21 matching the array of holes 16 in the upper shell structure 12, 14 (see FIGS. 3, 4 and 7). The posts 21 are made with a lower shoulder length 22 in which the shoulder length matches the contour of the upper shell structure 12, 14, as best illustrated in FIG. 2. A plurality of compression springs 23 each having a first end placed over each post 21 and resting on the upper shoulder surface of each post 21. The other end is compressed and placed into the open flanged end of the massaging piston urging the massaging piston 13 upward against the cylindrical sleeves 17, as illustrated in FIG. 7. The shapes of the closed ends are selected from a choice of nipple shaped ends 24 as shown in FIG. 5 or inserts 25 made from a permanent magnetic material as shown in FIG. 8. The arrangement and position of the various piston selections having different diameters and spring ratings are decided by the hole diameters and the contour in the upper shell structure 12, 14.

Figure 6:
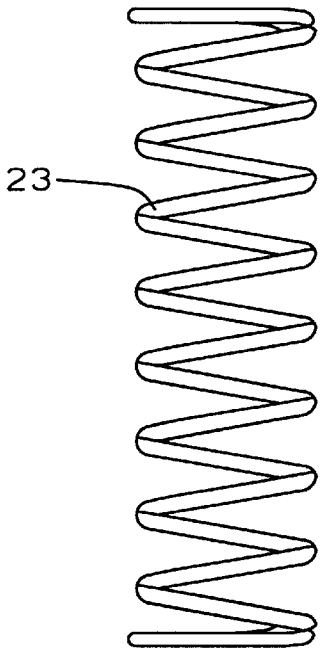
FIG. 6 is a side view of the spring of the foot nerve pulsator device of the present invention.

As shown in FIGS. 1, 2 and 4, the massaging pistons 13, are made with two different diameters. The larger massaging piston diameters are placed in rows 20 having the larger diameter holes, the smaller massaging piston diameters are placed in rows 19 with the smaller diameter holes. The springs 23, best illustrated in FIGS. 6 and 7, consist of a mix of lower spring rates and higher spring rates, at which the larger massaging piston diameters are paired with the springs having the higher spring rate and the smaller massaging piston diameters are paired with the springs having the lower spring rate.

As shown in FIG. 5, the tip of the closed end of the massaging piston 13 converges to a small nipple shaped end 24 which stimulates the acupuncture points on the soles of the feet. FIG. 8 shows the closed end of the massaging piston 13 which includes a magnetic insert 25. This insert enables the acupuncture points on the soles of the feet to be simultaneously stimulated by a magnetic field.

Figure 9:
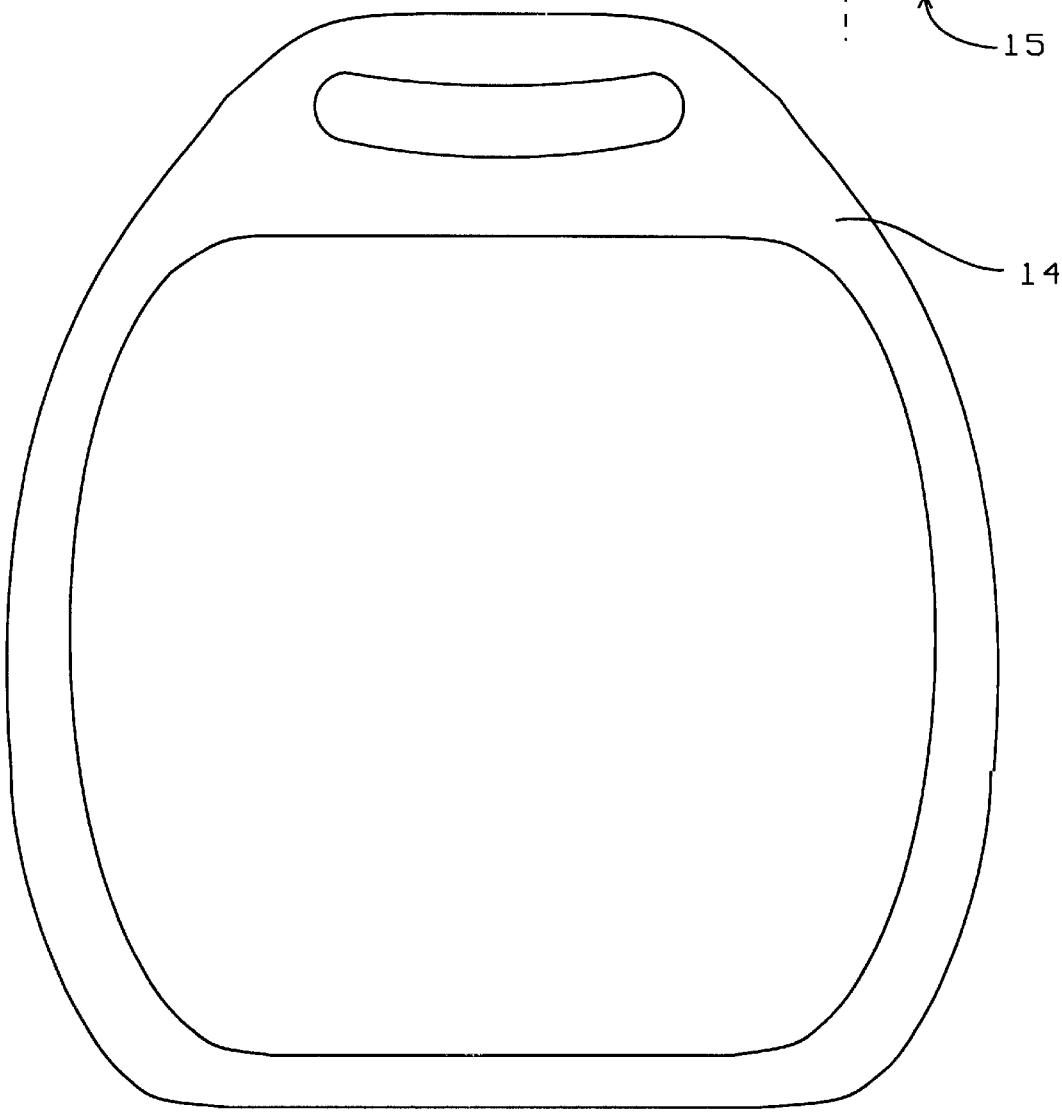
FIG. 9 is a top structural view of an upper cover ring of the present invention.
Figure 10:
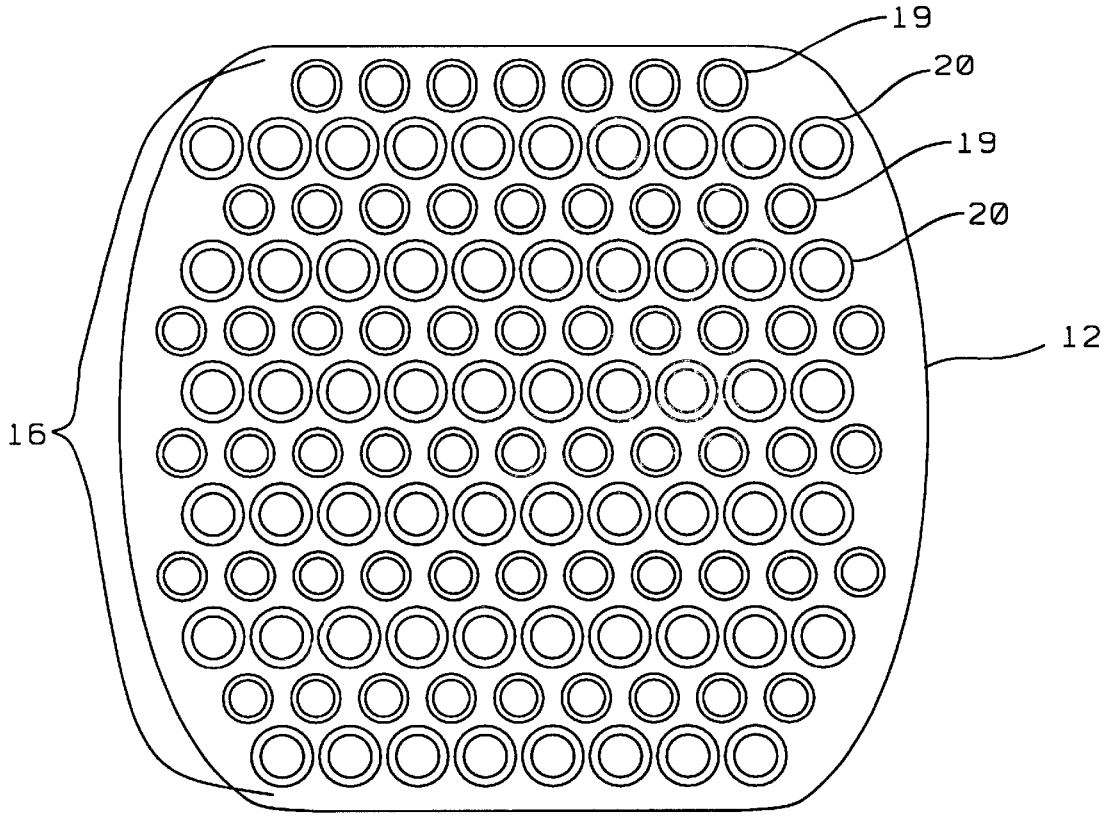
FIG. 10 is a top structure view of the upper cover of the present invention.

FIG. 4 illustrates the upper shell structure 12, 14 which includes the upper cover ring 14 and an upper cover 12. Top views of the upper cover ring 14 and the upper cover 12 are separately shown in FIGS. 9 and 10, respectively. FIG. 10 shows the array of holes 16 as previously described having alternate rows 19, 20, containing hole diameters corresponding to one of two different massaging piston diameters.

A top view of the base platform 11 is illustrated in FIG. 3. The base platform includes all the previously described post and shoulder details.

The foot nerve pulsator is assembled with the upper cover ring 14, containing the upper cover 12, is aligned with the base structure and secured with screws 18 around the periphery of the upper shell structure 12, 14 theretofore removably securing the piston and spring assembly. In view of the above structure of the present invention, it is comparatively simple to manufacture and to assemble.

While the invention has been particularly shown and described with reference to the preferred embodiments thereof, it will be understood by those skilled in the art that various changes in form and details may be made without departing from the spirit and scope of the invention.

What is claimed:

1. A nerve pulsator device for massaging an undersurface of a foot comprising:

an assembly having a molded upper shell structure contoured to said undersurface of a foot, said upper shell structure is secured at its base perimeter to a molded base platform, thereafter enclosing an array of hollow massaging pistons movable within an array of holes in said upper shell structure, said holes extending downward through cylindrical sleeves molded to an underside of said upper shell structure, said massaging pistons having a closed end and an open flanged end;

said molded base platform having an array of upwardly extended posts, said posts are arranged in alignment with said array of holes in said upper shell structure, said posts having a lower shoulder length with an upper annular surface, said shoulder length conforming with the contour of said upper shell structure;

a plurality of compression springs each having a first end placed over each post and resting on said upper annular surface of said lower shoulder length of said posts, the other end compressibly placed into said open flanged end of said massaging piston urging said massaging piston upward against said cylindrical sleeves.

2. The nerve pulsator device according to claim 1 wherein said upper shell structure is attached to said base platform by screws.

3. The nerve pulsator device according to claim 1 wherein said array of holes in said upper shell structure contains a plurality of rows, in which alternate rows have hole diameters corresponding to one of two different massaging piston diameters.

4. The nerve pulsator device according to claim 1 wherein said massaging pistons and springs are provided with different diameters and rates respectively to accommodate comfort to the user.

5. The nerve pulsator device according to claim 1 wherein said closed ends of massaging pistons are selected from a choice of nipple shaped ends or inserts made from a permanent magnetic material.

6. The nerve pulsator device according to claim 1 wherein said upper shell structure contoured to said undersurface of a foot includes both the plantar and transverse arch regions.

7. The nerve pulsator device according to claim 1 wherein said massaging pistons extend and retract providing thereof, a massaging sensation during treatment.

8. A nerve pulsator device for massaging an undersurface of a foot comprising:

an assembly having a molded upper shell structure contoured to said undersurface of a foot, said upper shell structure includes an upper cover ring mounted to the outside of an upper cover and the upper cover is removably secured to a molded base seat, thereafter enclosing an array of hollow massaging pistons movable within an array of holes in said upper shell structure, said massaging pistons having a closed end and an open flanged end;

said base seat having an array of upwardly extended posts matching said array of holes in said upper cover, said posts having a lower shoulder length with an upper annular surface, said shoulder length conforming with the contour of said upper shell structure;

a plurality of compression springs each having a first end placed over each post and resting on said upper annular surface of said lower shoulder length of said posts, the other end compressibly placed into said open flanged end of said massaging piston urging said open flanged end upward and stopping against an undersurface of said upper cover.

9. The nerve pulsator device according to claim 8 wherein said array of holes in said upper cover contains a plurality of rows, in which alternate rows have hole diameters corresponding to one of two different massaging piston diameters.

10. The nerve pulsator device according to claim 8 wherein said massaging piston diameters and spring rates are provided to accommodate comfort to the user.

11. The nerve pulsator device according to claim 8 wherein said closed ends of massaging pistons are selected from a choice of nipple shaped ends or inserts made from a permanent magnetic material.

12. The nerve pulsator device according to claim 8 wherein said upper shell structure contoured to said undersurface of a foot includes both the plantar and transverse arch regions.

13. The nerve pulsator device according to claim 1 wherein said massaging pistons extend and retract providing thereof, a massaging sensation during treatment.

14. A method for stimulating nerves of the plantar region at the undersurface of a foot using a stimulated device, said method comprising:

providing an assembly having a molded upper shell structure contoured to said undersurface of a foot, said upper shell structure includes an upper cover ring mounted to the outside of an upper cover and the upper cover is removably secured to a molded base seat thereafter enclosing an array of hollow massaging pistons movable within an array of holes in said upper shell structure, said massaging pistons having a closed end and an open flanged end;

said base seat having an array of upwardly extended posts matching said hole array in said upper cover, said posts having a lower shoulder length, said shoulder length conforming with the contour of said upper shell structure;

a plurality of compressed springs each having a first end placed over each post and resting on said lower shoulder length, the other end compressibly placed into said open flanged end of said massaging piston urging said flanged end upward and stopping against an undersurface of said upper cover.

15. The method of claim 14 wherein said array of holes in said upper shell structure contains a plurality of rows, in alternating sequence, in which each row have hole diameters corresponding to one of two different massaging piston diameters.

16. The method of to claim 14 wherein said massaging piston diameters and spring rates are provided to accommodate comfort to the user.

17. The method of claim 14 wherein said closed ends of massaging pistons are selected from a choice of nipple shaped ends or inserts made from a permanent magnetic material.

18. The method of claim 14 wherein said upper shell structure is contoured to said undersurface of a foot includes both the plantar and transverse arch regions.

19. The method of claim 14 wherein said massaging pistons extend and retract providing thereof, a massaging sensation during treatment.

20. The method of claim 14 wherein said stimulating the nerves of the plantar region of a foot is by placing said stimulating device on a foundation such as a floor, and positioning one's foot on the device and walking in place.

* * * * *